US012799761B2

(12) United States Patent
Johnson et al.

(10) Patent No.: US 12,799,761 B2
(45) Date of Patent: Nov. 17, 2026

(54) ADJUSTABLE STRAP COLLAR

(71) Applicant: DISH Wireless L.L.C., Englewood, CO (US)

(72) Inventors: Christopher Johnson, Parker, CO (US); Jerome A. LaPalme, Aurora, CO (US)

(73) Assignee: DISH Wireless L.L.C., Englewood, CO (US)

( * ) Notice: Subject to any disclaimer, the term of this patent is extended or adjusted under 35 U.S.C. 154(b) by 107 days.

(21) Appl. No.: 18/958,386

(22) Filed: Nov. 25, 2024

(65) Prior Publication Data

US 2025/0084661 A1 Mar. 13, 2025

Related U.S. Application Data

(62) Division of application No. 17/837,443, filed on Jun. 10, 2022, now Pat. No. 12,188,249.

(51) Int. Cl.
*E04H 12/22* (2006.01)

(52) U.S. Cl.
CPC ..... *E04H 12/22* (2013.01)

(58) Field of Classification Search
CPC ... E04H 12/22; F16B 2/20; F16B 2/08; G09F 2007/1804; G09F 2007/1808; G09F 2007/1813; G09F 2007/1817; G09F 2007/1821; G09F 2007/1826; G09F 2007/183
See application file for complete search history.

(56) References Cited

U.S. PATENT DOCUMENTS 3,241,800 A * 3/1966 Richter, III ..... F16L 3/137 248/230.9
4,460,142 A 7/1984 O'Rorke
4,860,985 A 8/1989 Olson et al.
5,301,911 A * 4/1994 Beauchemin ..... F16M 11/041 248/218.4

(Continued)

FOREIGN PATENT DOCUMENTS

DE 3201135 A1 7/1983
DE 202021003788 U1 2/2022

(Continued)

*Primary Examiner* — Theodore V Adamos
(74) *Attorney, Agent, or Firm* — Wash Park IP Ltd.; John T Kennedy

(57) ABSTRACT

A process, device and system facilitate mounting of apparatus on a tower. The process includes positioning a tunnel void clip on a strap, positioning the strap on the tower, fastening the strap to the tower, resting a first bracket on the clip, and fastening the first bracket, at a mounting position, onto the tower. The tunnel void clip includes a top portion, inner and outer prongs, a top connecting portion couples the top portion to the outer prong, and to the tops of the inner and outer prongs. A bottom connecting portion couples bottoms of the inner and outer prongs. The top and bottom connecting portions separate the inner and outer prongs to form a void therebetween, and the top and bottom connection portions, the inner and outer prongs and the void collectively form a tunnel void within the tunnel void clip through which the strap may be inserted.

17 Claims, 10 Drawing Sheets

(56) References Cited

U.S. PATENT DOCUMENTS

| | | | | |
|---|---|---|---|---|
| 5,427,344 | A * | 6/1995 | Beauchemin | A44B 11/125 182/187 |
| 5,702,081 | A | 12/1997 | Gallemore, II | |
| 6,196,511 | B1 * | 3/2001 | Beauchemin | A45F 3/00 248/339 |
| 6,398,596 | B1 * | 6/2002 | Malin | H01R 4/42 439/100 |
| 7,810,265 | B2 | 10/2010 | Beatty | |
| 7,997,546 | B1 | 8/2011 | Andersen et al. | |
| 8,863,419 | B1 * | 10/2014 | Pace | G09F 15/0018 248/219.3 |
| 9,200,654 | B1 | 12/2015 | Parduhn | |
| 10,474,013 | B2 | 11/2019 | Wynalda, Jr. et al. | |
| 11,649,910 | B2 * | 5/2023 | Bendlak | F16L 3/1033 24/135 R |
| 2006/0231707 | A1 * | 10/2006 | Schrot | A01M 31/02 248/218.4 |
| 2017/0263119 | A1 | 9/2017 | Campbell et al. | |
| 2018/0102074 | A1 * | 4/2018 | Peters | G09F 17/00 |
| 2022/0248662 | A1 | 8/2022 | Wynalda, Jr. | |
| 2023/0063925 | A1 * | 3/2023 | Wynalda, Jr. | F16M 11/38 |

FOREIGN PATENT DOCUMENTS

| | | | | |
|---|---|---|---|---|
| EP | 0437211 | A1 * | 7/1991 | B62H 5/003 |
| KR | 200176391 | Y1 | 3/2003 | |
| KR | 20230043746 | A | 3/2023 | |

* cited by examiner

ADJUSTABLE STRAP COLLAR

CROSS-REFERENCE TO RELATED MATTERS

This application is a Divisional application and claims priority to U.S. patent application Ser. No. 17/837,443, which was filed on 10 Jun. 2022, in the name of inventors Christophers Johnson and Jeroma A. LaPalme, and entitled "Adjustable Strap Collar" (herein, the "'443 Application"); the entire contents of the '443 Application are incorporated herein by reference.

TECHNICAL FIELD

The subject matter described herein relates to devices, systems and methods for securing apparatus to a tower structure.

BACKGROUND

Various forms of structures, such as cellular towers, and the like commonly involve a central member, such as a mono-pole tower (herein, a "tower", upon which various apparatus are attached. Non-limiting examples of apparatus include antennas, amplifiers, signal processors, and the like. When combined, a structure includes a tower and one or more apparatus, with the tower being affixed to a base at a ground plane, such as a surface of the Earth. The tower commonly being affixed to the base using bolts, guide wires, or otherwise.

Commonly, the structure is assembled by first affixing the tower to the base and then attaching the one or more apparatus to the tower. The apparatuses are often attached to the tower at one or more elevations above the base. The apparatus may be heavy, such as weighing more than fifteen kilograms (15 kg.) and/or awkward to maneuver and attached to the tower. Often the height at which an apparatus is attached to the tower may be several tens of meters above the ground elevation. Further, it is often the case that multiple apparatuses are to be attached to the tower at a common, horizontal, elevation. These considerations and others often make the attachment of apparatus to a tower today an activity which often utilizes multiple lift structures and personnel. Accordingly, needs exist for devices, systems and methods for attaching apparatus to a tower. The various implementations described herein address these and other considerations.

SUMMARY

In accordance with at least one implementation of the present disclosure, a process may include first positioning a clip on a strap. The clip may be a channel void clip or a tunnel void clip. The process may include second positioning the strap on a tower, first fastening the strap to the tower, resting a first bracket on the clip, and second fastening the first bracket, at a mounting position, onto the tower.

Implementations may include one or more of the following features. The tunnel void clip may include: a top portion; an outer prong; an inner prong; a top connecting portion coupling the top portion to the outer prong, and further coupling a top of the inner prong to a top of the outer prong; and a bottom connecting portion coupling a bottom of the inner prong to a bottom of the outer prong. The top connecting portion and bottom connecting portion separate the inner prong from the outer prong to form a void therebetween. The top connection portion, the bottom connecting portion, the inner prong, and the outer prong and the void collectively form a tunnel void within the tunnel void clip.

The strap includes a first end, a middle portion and a second end. The tunnel void clip has dimensions configured to accept slidable insertion of one of the first end and the second end into and therethrough. The first fastening further may include: overlapping the first end and the second end to form an overlapping region; and securing the overlapping region with a fastener.

The channel void clip may include: a top portion; an outer prong; an inner prong; and a top connecting portion coupling the top portion to the outer prong, and further coupling a top of the inner prong to a top of the outer prong. The top connecting portion separates the inner prong from the outer prong to form a channel void within the channel void clip.

The strap includes as first end, a middle portion and a second end; where the channel void has dimensions configured to accept placement of the channel void clip onto the strap by the inner prong and the outer prong overlapping some of the middle portion of the strap.

The first fastening further may include: overlapping the first end and the second end to form an overlapping region; and securing the overlapping region with a fastener.

The channel void clip further may include a pin. The strap further may include an eyelet. The first positioning of the channel void clip on the strap further may include: aligning the pin with the eyelet. The second positioning of the strap on the tower further may include: rotating the strap around a circumference of the tower until the eyelet is aligned with the mounting position. The strap includes a first end, a middle portion and a second end. The first fastening further may include: overlapping a first end of the strap with a second end of the strap to form an overlapping region of the strap; rotating the strap around a circumference of the tower until at least one of the channel void clip and the tunnel void clip positioned on the strap is aligned with the mounting position; and securing the overlapping region with a fastener. Upon securing of the overlapping region, the strap is fastened to the tower and the clip is aligned with the mounting position for the bracket. The fastener may be a hose clamp. The second fastening further may include: tightening a tensioner coupled to first bracket and a second bracket; where the second bracket rests on a second clip positioned on the strap. The process may include: third fastening an apparatus to the first bracket. The apparatus may be a wireless communications component.

For at least one implementation, the tunnel void clip also includes a top portion; an outer prong; an inner prong; a top connecting portion coupling the top portion to the outer prong and further coupling the inner prong to the outer prong; and a bottom connecting portion coupling a bottom of the inner prong to a bottom of the outer prong. The top connecting portion and bottom connecting portion separate the inner prong from the outer prong to form a tunnel void therebetween. The tunnel void has dimensions which accept slidable insertion of one of a first end and a second end of a strap into and through the tunnel void. Upon fastening of the strap onto a structure, the tunnel void clip and the strap provide a supporting assembly for a bracket during fastening of the bracket onto the structure.

Implementations may include one or more of the following features. The tunnel void clip has a length of approximately forty-eight millimeters (48 mm), a width of approximately thirty-eight millimeters (38 mm), and a height of approximately thirty-eight millimeters (38 mm). The tunnel void has a length of approximately three millimeters. The structure may be a tower.

The channel void clip may also include a top portion; an outer prong; an inner prong; and a top connecting portion coupling the top portion to the outer prong, and further coupling a top of the inner prong to a top of the outer prong. The top connecting portion separates the inner prong from the outer prong to form a channel void therebetween. The channel void has dimensions which accept placement of the channel void clip onto a strap by the inner prong and the outer prong overlapping some of a middle portion of the strap. Upon fastening of the strap onto a structure, the channel void clip and the strap provide a supporting assembly for a bracket during fastening of the bracket onto the structure.

Implementations may include one or more of the following features. The channel void clip has length of approximately forty-eight millimeters (48 mm), a width of approximately thirty-eight millimeters (38 mm), and a height of approximately thirty-three millimeters (33 mm). The strap further may include an eyelet. The pin is insertable into the eyelet during the fastening of the strap on the structure. The structure is a tower, and the bracket facilitates mounting of an apparatus to the radio communications tower.

DETAILED DESCRIPTION

In accordance with at least one implementation of the present disclosure, various implementations of adjustable collar straps, clips for use with the various adjustable collar strap implementations, and assemblies are described and configured for use in attaching one or more apparatus to a tower. For an implementation, adjustable collar strap, a clip for use therewith, a tower, and an apparatus and tensioners for use with the apparatus may any structure and/or configuration which facilitates attachment of an apparatus to a tower.

Figure 1:
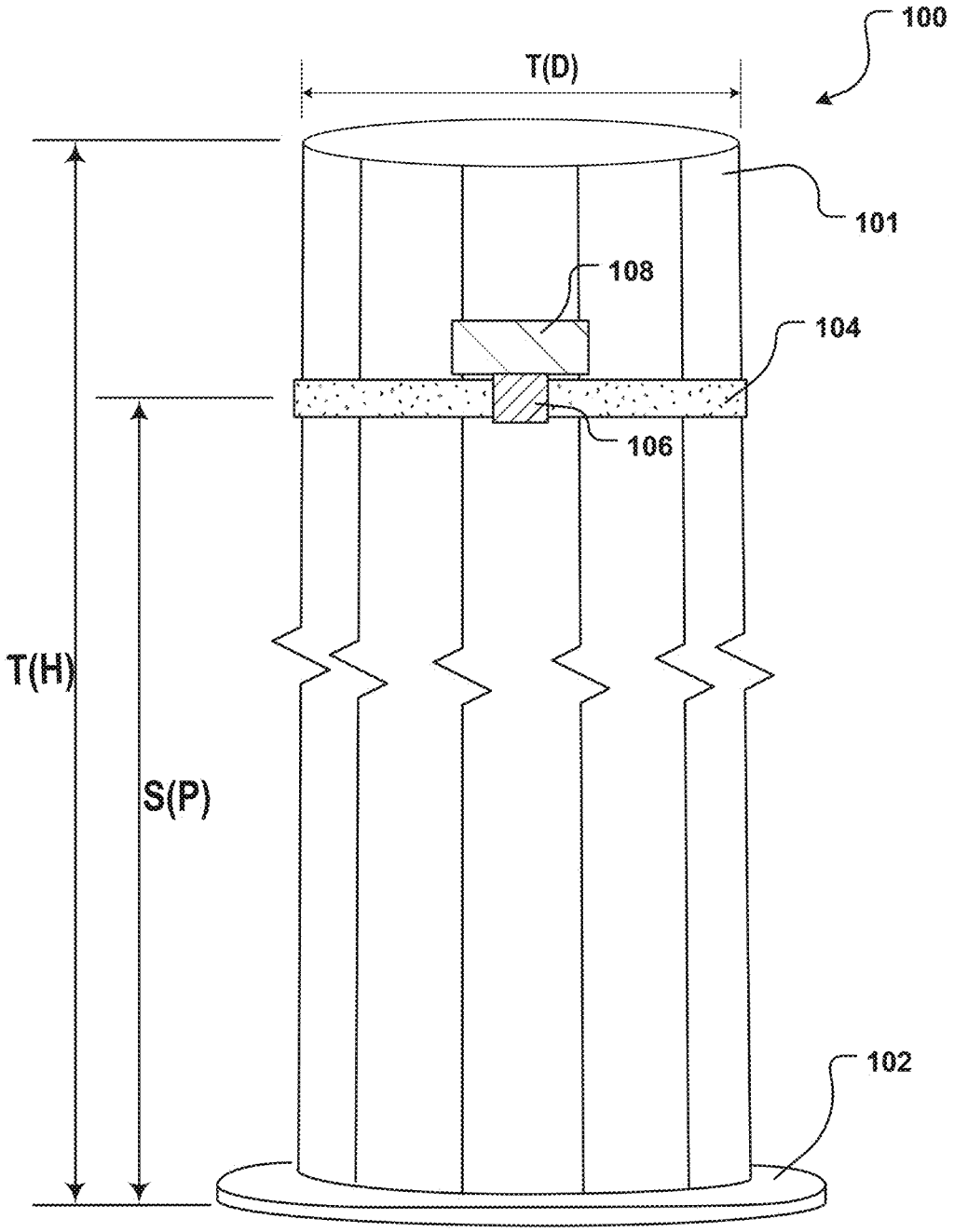
FIG. 1 is a side view of a tower, and an implementation of an adjustable collar strap configured in accordance with at least one first implementation of the present disclosure.

As shown in FIG. 1, a structure 100 may include a tower 101 and a base 102. The tower 101 may have a height T(H) and, a width (not shown) or diameter T(D) (when provided in a cylindrical or similar structure. The tower 101 may have any dimensions, may be configured in any form, such as a tube, a hexagon shaped structure, as a square (when viewed from the top), or otherwise. The tower 101 may be configured from any material with non-limiting examples including steel, aluminum, wood, graphite, carbon, ceramic materials, or otherwise. The tower 101 may or may not be electrically conductive, may be grounded to the base 102, or have other electrical and other properties. The tower 101 may be affixed to the base 102 using any known or later arising fasteners.

An adjustable collar strap 104 configured in accordance with at least one implementation of the present disclosure may be positioned on the tower 101. A clip 106 may be suitably attached to the adjustable collar strap 104 (herein, a "strap"). One or more clips 106 may facilitate positioning of a bracket 108 at an elevation of the tower 101 as measured, for a non-limiting distance S(P) from the base 102. For at least one implementation, a strap 104 and a clip 106 may be first positioned on the tower 101 at a given height and on a level plane. The combined strap 104 and clip 106 may be used to provide a support on which a bracket 108 may be rested while the bracket 108 is attached to the tower 101. Attachment of the bracket 108 to the tower 101 may use any known or later arising components, assemblies, techniques and the like, while the strap 104 and clip 106 combined provide a "supporting assembly." The bracket 108 may further provide a mounting structure for attachment of one or more apparatus (not shown) to the tower 101.

For an implementation, the supporting assembly may be configured for use during attachment of one or more brackets 108, and/or apparatus, to a tower 101. The supporting assembly may be configured for removal from a tower 101 after one or more brackets 108 have been attached to the tower 101. Upon removal, the supporting assembly may be reusable for attaching additional brackets 108 to a given tower 101 and/or to another tower.

Figure 2A:
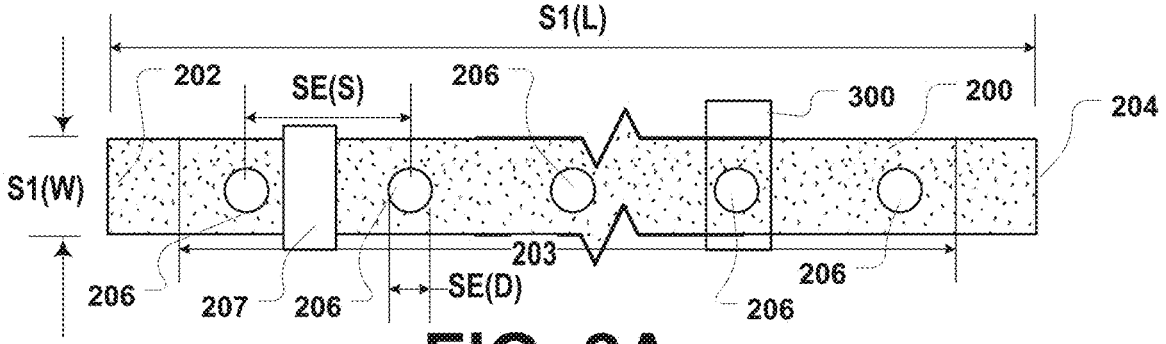
FIG. 2A is a side view of a first adjustable collar strap configured in accordance with at least one first implementation of the present disclosure.
Figure 2B:
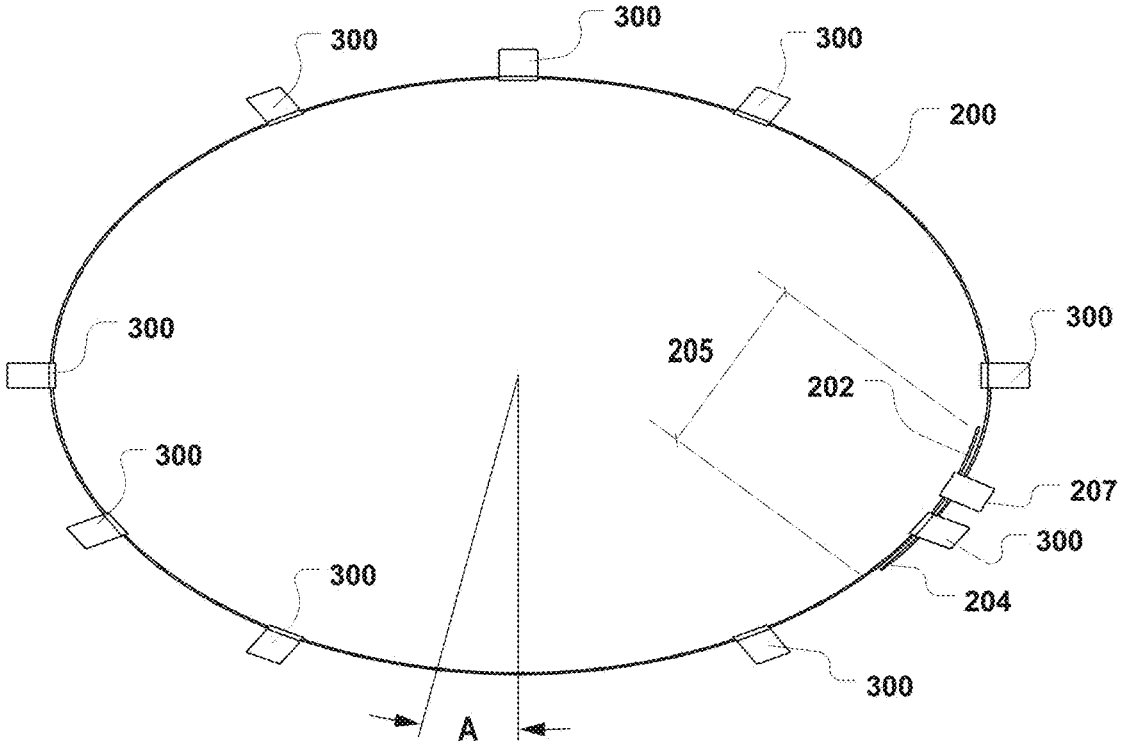
FIG. 2B is a top view of the first adjustable collar strap of FIG. 2A and in accordance with at least one first implementation of the present disclosure.
Figure 2C:
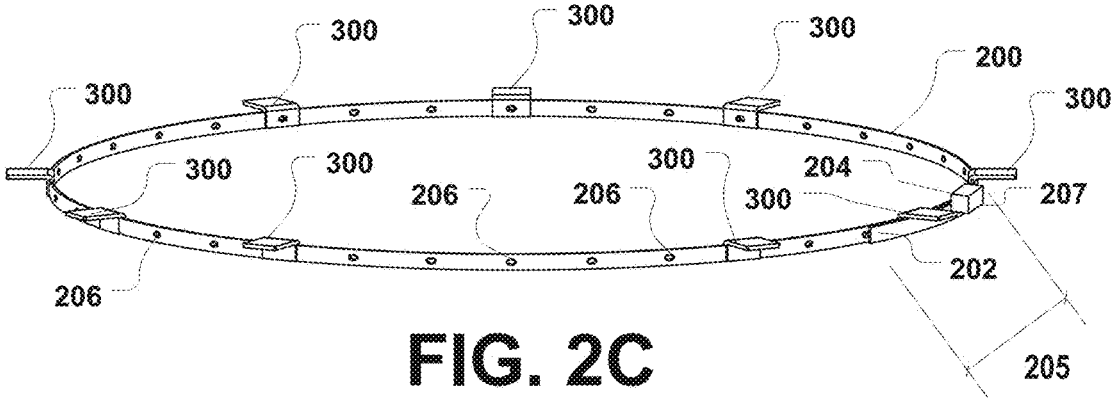
FIG. 2C is a perspective view of the first adjustable collar strap of FIGS. 2A-2B and in accordance with at least one first implementation of the present disclosure.
Figure 3A:
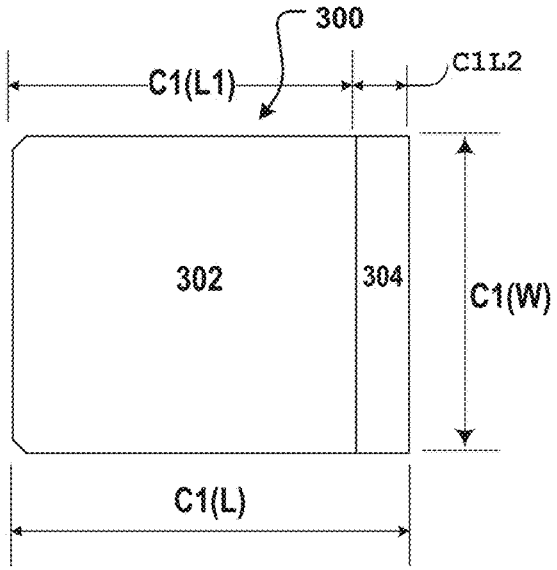
FIG. 3A is a top view of a first clip configured for use with the first adjustable collar strap of FIGS. 2A-2C and in accordance with at least one first implementation of the present disclosure.
Figure 3B:
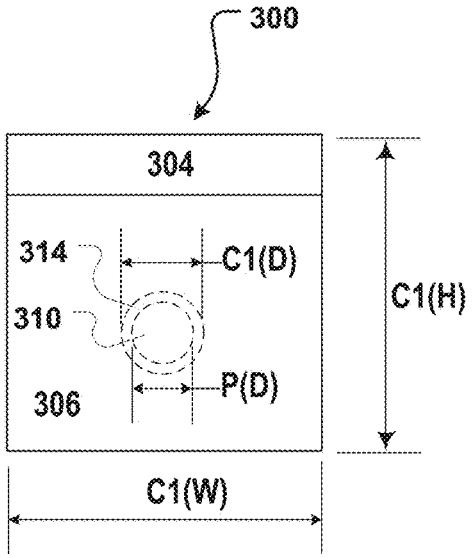
FIG. 3B is a front view of the first clip of FIG. 3A and in accordance with at least one first implementation of the present disclosure.
Figure 3C:
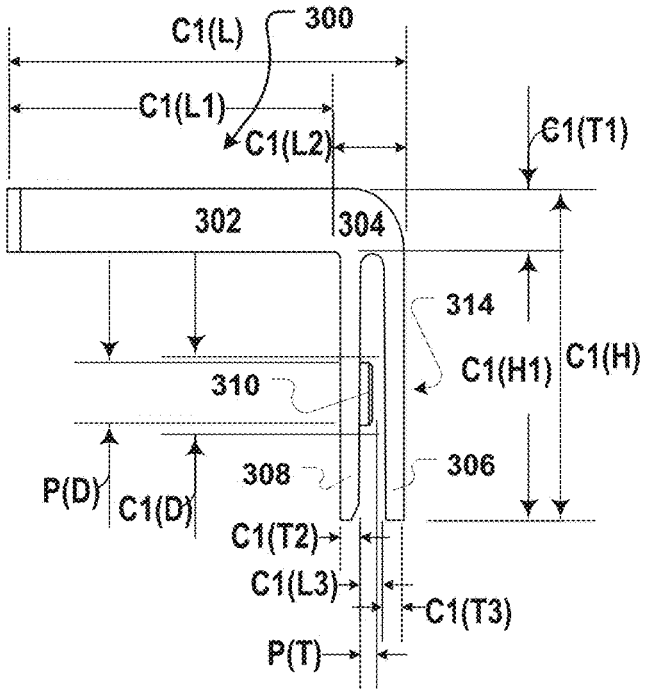
FIG. 3C is a side view of the first clip of FIGS. 3A-3B and in accordance with at least one first implementation of the present disclosure.
Figure 3D:
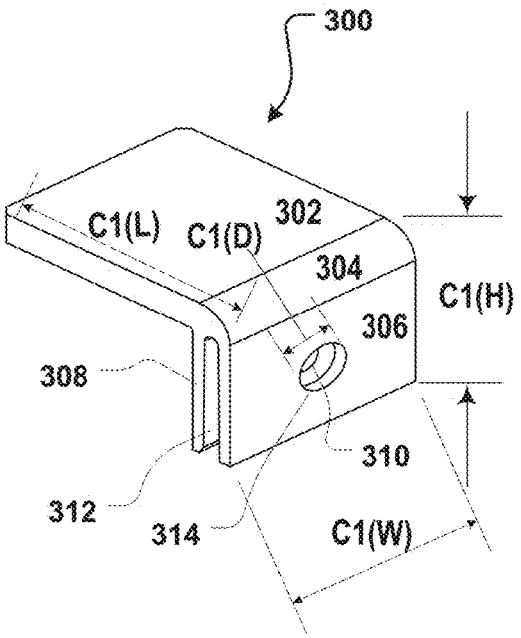
FIG. 3D is a perspective view of the first clip of FIGS. 3A-3C and in accordance with at least one first implementation of the present disclosure.

As shown in FIGS. 2A-2C, for at least one first implementation of the present disclosure, a first strap 200 may have a first strap width S1(W), a first strap length S1(L), and a first strap thickness S1(T) (not shown). For an implementation, S1(W) may be approximately twenty-five millimeters (25 mm), S1(L) may be approximately between three-hundred and six-hundred centimeters (300-600 cm), and S1(T) may be approximately two millimeters (2 mm). Other widths, lengths and thicknesses may be used for other implementations.

As further shown, the first strap 200 may have a first strap first end 202 that is connected by a first strap middle 203 to a first strap second end 204. A first clamp 207 may be used to fasten the ends together when the first strap 200 is in an assembled state and positioned about a tower (not shown). For an implementation, a first clamp 207 may be a hose clamp. As shown in FIGS. 2B and 2C, when in an assembled state, portions of the first strap first end 202 and the first strap second end 204 may overlap, as shown by a first strap overlap region 205, and may be secured by the first clamp 207. In other implementations, other forms of fasteners may be used to fasten the first strap first end 202 with the first strap second end 204 with non-limiting examples includes use of crimps, bolts, screws, welding, or otherwise.

The first strap 200 may include a plurality of eyelets 206. For an implementation, the eyelets 206 may be spaced equidistantly along the length of the first strap 200. For an implementation, two eyelets 206 may have a strap eyelet spacing SE(S) therebetween of approximately seventy-five millimeters (75 mm). For an implementation, an eyelet 206 may have a strap eyelet diameter SE(D) of approximately eight millimeters (8 mm).

For an implementation, the first strap 200 may be formed polyester, nylon, and other forms of flexible materials. The first clip 300 may be formed from aluminum, molded of machined plastic, carbon fiber, graphite, or other lightweight materials.

As shown in FIG. 2B, eyelets 206 may be spaced at an angle of "A" degrees along the first strap length S1L of the first strap 200. For an implementation, A equals ten degrees.

As shown in FIGS. 2A-2C and further shown in FIGS. 3A-3D, one or more first clips 300 may be spaced along the first strap length S1(L) of the first strap 200. The first clip 300 may have a first clip length C1(L), a first clip width C1(W), a first clip height C1(H), and various thicknesses, as shown by a first clip first thickness C1(T1), a first clip second thickness C1(T2) and a first clip third thickness C1(T3). For an implementation C1(T2) is approximately equal to C1(T3).

A first clip 300 may include a first top portion 302 that is connected by a first connecting portion 304 to a first outer prong 306. For an implementation, the first top portion 302 and the first outer prong 306 may be approximately flat surfaces that are oriented approximately perpendicularly. The first connecting portion 304 may have a square, curved or another configuration. For an implementation, the first connecting portion 304 may be curved and have an exterior arc length of approximately six millimeters (6 mm) and an interior arc length of less than one millimeter (1 mm).

For an implementation, the first clip length C1(L) may be approximately forty-eight millimeters (48 mm) and include a first clip top length C1(L1) of approximately forty millimeters (40 mm) and a first clip connecting length C1(L2) of approximately eight millimeters (8 mm). For an implementation, the first clip width C1(W) may be approximately thirty-eight millimeters (38 mm). For an implementation, the first clip height C1(H) may be approximately thirty-three millimeters (33 mm).

The first clip 300 may include a first inner prong 308 connected to the first connecting portion 304. The first inner prong 308 may oppose and be separated from the first outer prong 306 by a channel void 312 having a channel void length C1(L3). The channel void 312 may be formed as a "U" shaped structure which facilitates attachment of the first clip 300 to the first strap 200 by sliding the first strap 200 into the channel void 312. The first inner prong 308 and the first outer prong 306 may have different or substantially equivalent first clip prong heights C1(H1). For an implementation, the first inner prong 308 may have the first clip second thickness C1(T2) and the first outer prong 306 may have the first clip third thickness C1(T3). For an implementation, the channel void length C1(L3) is substantially equal to three millimeters (3 mm). For an implementation, the channel void length C1(L3) may be substantially equivalent to the first strap thickness S1(T) less two millimeters (2 mm). For an implementation, the first inner prong 308 may have a curved lower portion while the first outer prong 306 has a squared off lower portion.

The first inner prong 308, first connecting portion 304, and first outer prong 306 may form the channel void 312 and configure the first clip 300 for sliding insertion onto the first strap 200.

The first clip 300 may include a pin 310 and an opening 314 having a clip diameter C(D). The pin 310 may be partially provided in the void C(L3) and on the first inner prong 308. The opening 314 may be provided on the first outer prong 306. The opening 314 may allow for an installer to apply pressure upon the pin 310 to facilitate removal of a first clip 300 from a first strap 200. The pin 310 may have a pin diameter P(D) that is sized for mating with an eyelet 206 in the first strap 200. For an implementation, the pin diameter P(D) is approximately six millimeters (6 mm), and the clip diameter C(D) is approximately nine millimeters (9 mm). For an implementation, the pin thickness P(T) is approximately equal to the strap thickness S(T).

For an implementation, the pin 310 facilitates securing of a first clip 300 onto a first strap 200 such that the first clip 300 is not dislodged during attachment of the supporting assembly to a tower 101.

Figure 4A:
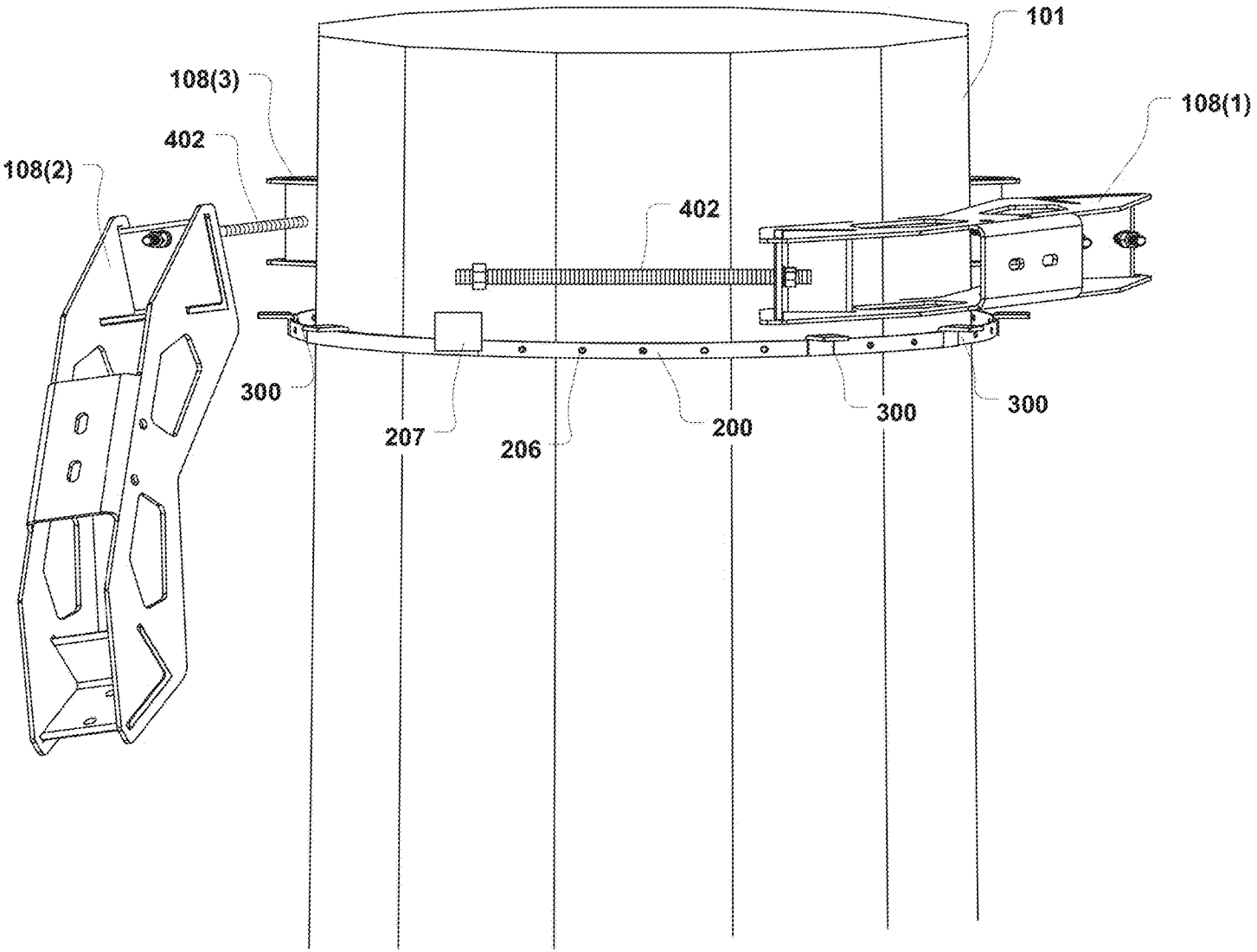
FIG. 4A is a partially assembled view of a first assembly of various apparatuses to a tower using the first adjustable collar strap of FIGS. 2A-2C and the first clip of FIGS. 3A-3D and in accordance with at least one first implementation of the present disclosure.
Figure 4C:
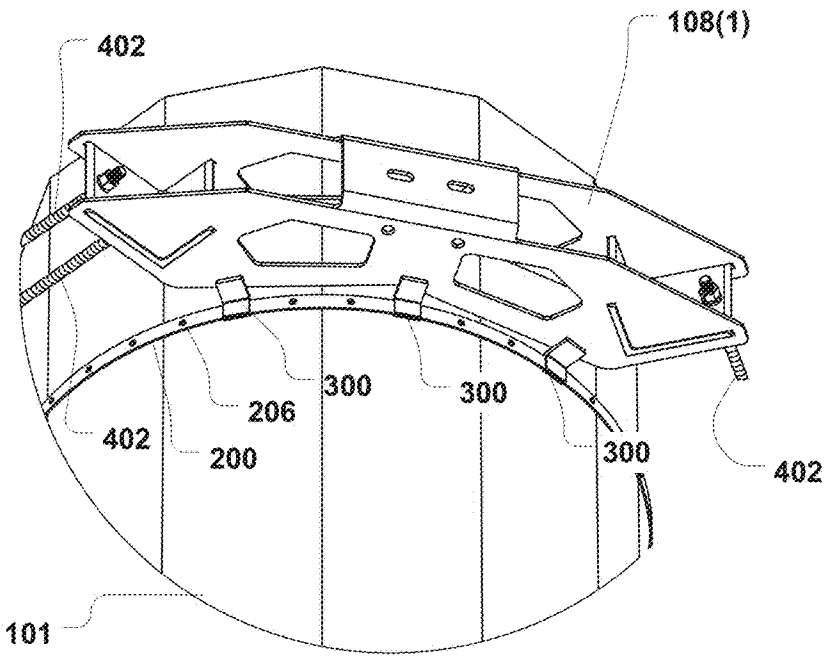
FIG. 4C is a bottom, enlarged side view of the first assembly of FIGS. 4A-4B.
Figure 4B:
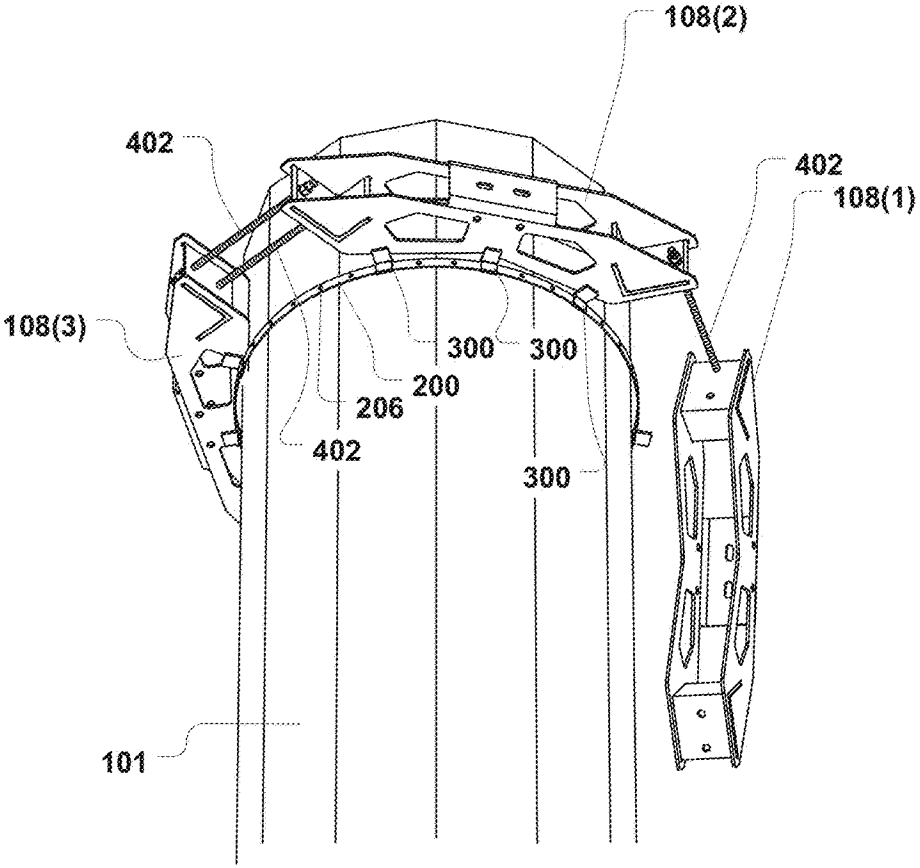
FIG. 4B is a bottom side view of the first assembly of FIG. 4A.

As shown in FIGS. 4A-4C, a supporting assembly (which includes the first strap 200 and a plurality of first clips 300) may be attached to a tower 101 by the before-mentioned overlapping of the first strap first end 202 and the first strap second end 204 and securing the first strap 200 by use of the first clamp 207. For an implementation, the first clamp 207 may be a ratcheting mechanism or other known mechanism for permanently or temporarily affixing the first strap 200 to the tower 101. It is to be appreciated that attachment of the supporting assembly to a tower 101 may be performed using various tools or equipment and the supporting assembly may be attached to be substantially parallel to a given ground or another horizontal plane. Further, one or more first clips 300 may be positioned on the first strap 200 and at one or more locations so as to facilitate the positioning, supporting and attachment of one or more brackets 108 about the tower 101. A given bracket 108 may be supported by any number of first clips 300. It is to be appreciated that the positioning of the one or more first clips 300 about the first strap 200 may coincide with a given location about a circumference of the tower 101.

For an implementation, one or more brackets 108 may be attached to a tower 101 using any known or later arising fasteners and/or fastening technologies. While being fastened to a tower 101, a bracket 108 may be supported by the supporting assembly. As shown, for at least one implementation, a first bracket 108(1) may be attached to a second bracket 108(2), which in turn may be attached to a third bracket 108(3), and so forth by one or more tensioners 402, such as one or more machine bolts, or the like.

For an implementation, brackets 108 may be attached to the tower 101, while being supported by a supporting assembly, using metal straps, welding, fasteners (such as bolts, screws, or the like), or any other known or later arising materials and techniques for fastening an object to a tower 101. It is to be appreciated that upon completing a circle of brackets 108 coupled by tensioners 402, and the tightening of the tensioners 402, a plurality of brackets 108 may be attached and affixed (by surface tension) to a tower 101, on a substantially horizontal plane that is parallel to a given reference plane, such as a ground plane, and at a height set by an earlier attachment of a supporting assembly to the tower 101. The brackets 108 may be used for attachment of one or more apparatus to the tower 101.

For an implementation, the brackets 108 may not be utilized and the one or more apparatus may be attached directly to a tower 101 using a supporting assembly configured in accordance with an implementation of the present disclosure.

Figure 5A:
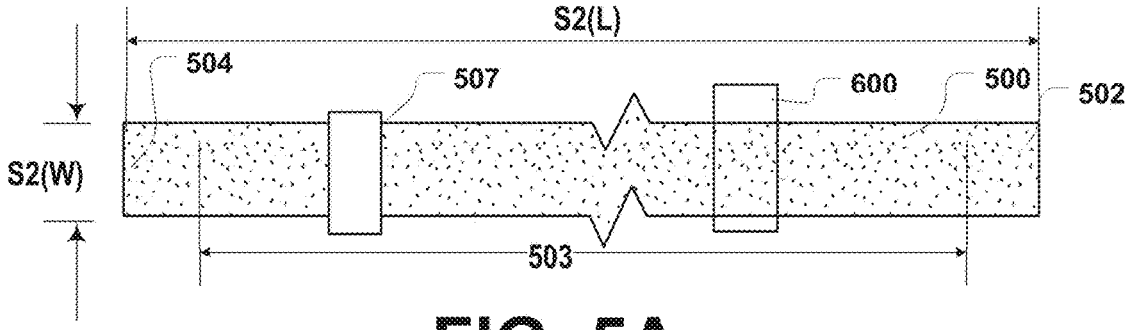
FIG. 5A is a side view of a second adjustable collar strap configured in accordance with at least one second implementation of the present disclosure.
Figure 5B:
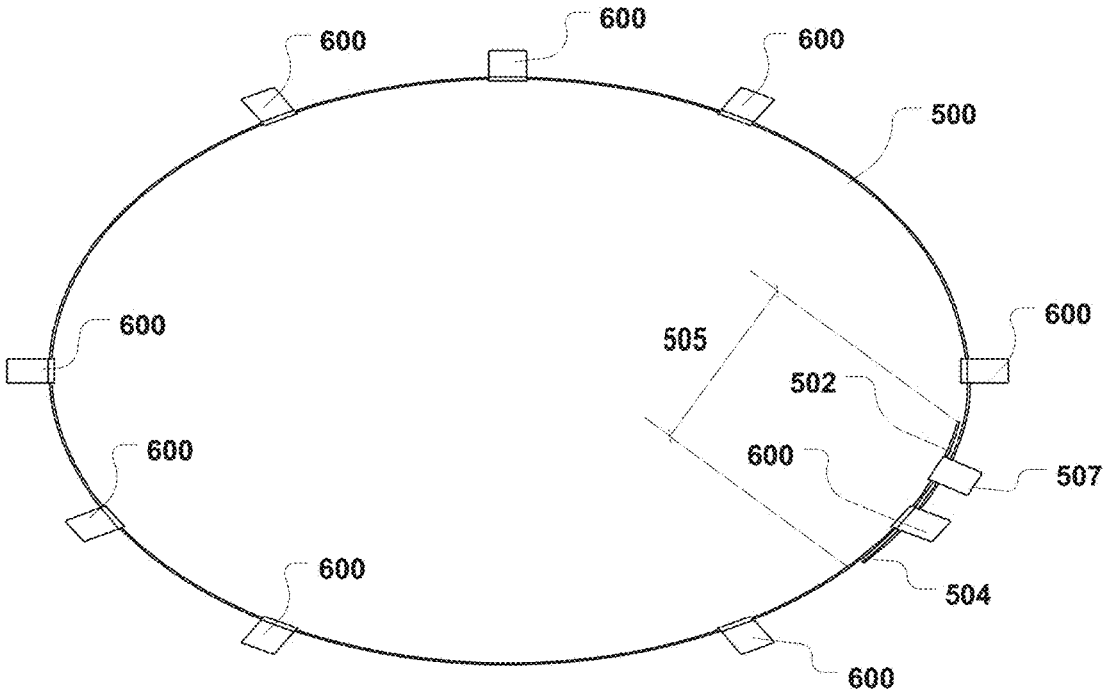
FIG. 5B is a top view of the second adjustable collar strap of FIG. 5A and in accordance with at least one second implementation of the present disclosure.
Figure 5C:
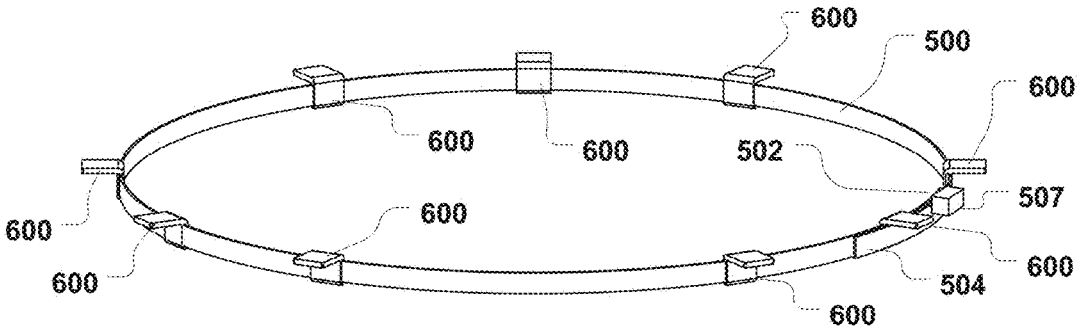
FIG. 5C is a perspective view of the second adjustable collar strap of FIGS. 5A-5B and in accordance with at least one second implementation of the present disclosure.
Figure 6A:
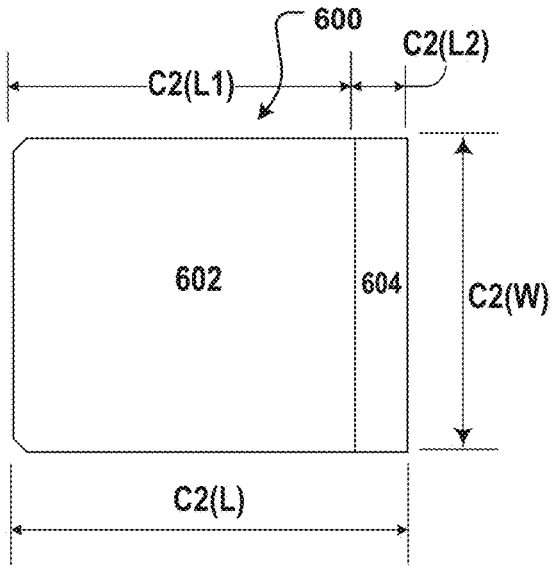
FIG. 6A is a top view of a second clip configured for use with the second adjustable collar strap of FIGS. 5A-5C and in accordance with at least one second implementation of the present disclosure.
Figure 6B:
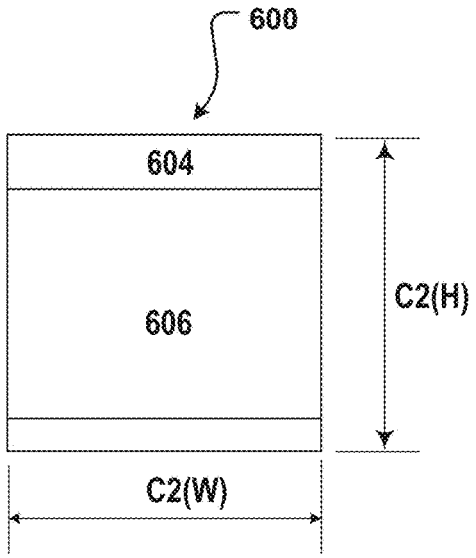
FIG. 6B is a front view of the second clip of FIG. 6A and in accordance with at least one second implementation of the present disclosure.
Figure 6C:
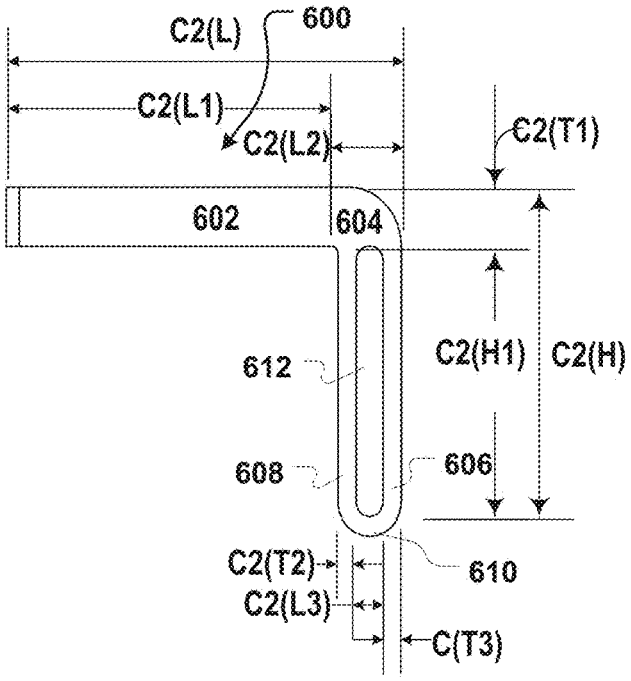
FIG. 6C is a side view of the second clip of FIGS. 6A-6B and in accordance with at least one second implementation of the present disclosure.
Figure 6D:
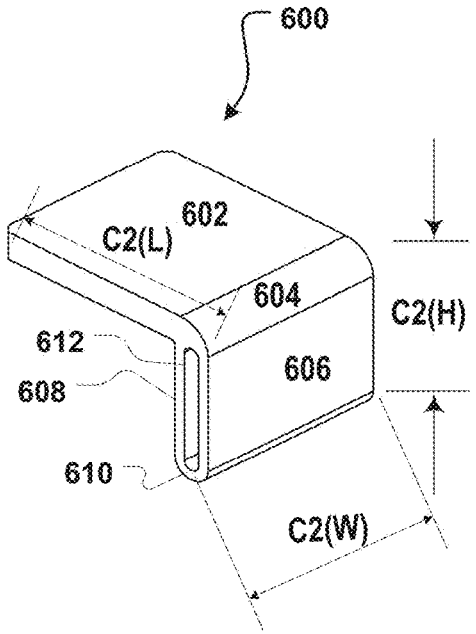
FIG. 6D is a perspective view of the second clip of FIGS. 6A-6C and in accordance with at least one second implementation of the present disclosure.

As shown in FIGS. 5A-5C and for a second implementation of the present disclosure, a second strap 500 may have a second strap width S2(W), a second strap length S2(L), and a second strap thickness S2(T) (not shown). For an implementation, S2(W) may be approximately twenty-five millimeters (25 mm), S2(L) may be approximately between three-hundred and six-hundred centimeters (300-600 cm), and S2(T) may be approximately two millimeters (2 mm). Other widths, lengths and thicknesses may be used for other implementations.

As further shown, the second strap 500 may have a second strap first end 502 that is connected by a second strap middle portion 503 to a second strap second end 504. A second clamp 607 may be used to fasten the ends together when the second strap 500 is in an assembled state and positioned about a tower (not shown). For an implementation, a second clamp 507 may be a hose clamp. As shown in FIGS. 5B and 5C, when in an assembled state, portions of the second strap first end 502 and the second strap second end 504 may overlap, as shown by a second strap overlap region 505, and may be secured by the second clamp 507. In other implementations, other forms of fasteners may be used to fasten the second strap first end 502 with the second strap second end 504 with non-limiting examples includes use of crimps, bolts, screws, welding, or otherwise.

For an implementation, the second strap 500 may be formed from polyester, nylon, and other forms of flexible materials. The second clip 600 may be formed from aluminum, molded of machined plastic, carbon fiber, graphite, or other lightweight materials.

As shown in FIGS. 5A-5C and further shown in FIGS. 6A-6D, one or more second clips 600 may be spaced along the second strap length S2(L) of the second strap 500. The second clips 600 may have a second clip length C2(L), a second clip width C2(W), a second clip height C2(H), and various thicknesses, as shown by a second clip second thickness C2(T1), a second clip second thickness C2(T2) and a second clip third thickness C2(T3). For an implementation C2(T2) is approximately equal to C2(T3).

A second clip 600 may include a second top portion 602 that is connected by a second top connecting portion 604 to a second outer prong 606. For an implementation, the second top portion 602 and the second outer prong 606 may be approximately flat surfaces that are oriented approximately perpendicularly. The second top connecting portion 604 may have a square, curved or another configuration. For an implementation, the second top connecting portion 604 may be curved and have an exterior arc length of approximately six millimeters (6 mm) and an interior arc length of less than one millimeter (1 mm).

The second clip 600 may further include a second bottom connecting portion 610 that connects the second outer prong 606 to a second inner prong 608, with the second inner prong 608 being further connected to the second top connecting portion 604.

For an implementation, the second clip length C2(L) may be approximately forty-eight millimeters (48 mm) and include a second clip top length C2(L1) of approximately forty millimeters (40 mm) and a second clip connecting length C2(L2) of approximately eight millimeters (8 mm). For an implementation, the second clip width C2(W) may be approximately thirty-eight millimeters (38 mm). For an implementation, the second clip height C2(H) may be approximately thirty-eight millimeters (38 mm).

The second clip 600 may include a second inner prong 608 connected to the second top connecting portion 604 and the second bottom connecting portion 610. The second inner prong 608 may oppose and be separated by a tunnel void 612, having a tunnel void length C2(L3), from the second outer prong 606. The second inner prong 608 and the second outer prong 606 may have equivalent second clip prong heights C2(H1). For an implementation, the second inner prong 608 may have the second clip second thickness C2(T2) and the second outer prong 606 may have the second clip third thickness C2(T3). For an implementation, the tunnel void 612 has a tunnel void length C2(L3) that is substantially equal to three millimeters (3 mm). For an implementation, the tunnel void 612 and the tunnel void length C2(L3) may be substantially equivalent to the second strap thickness S2(T) less two millimeters (2 mm). The tunnel void 612 facilitates attachment of the second clip 600 to the second strap 500 by a sliding engagement of either the second strap first end 502 or the second strap second end 504 into the tunnel void 612. Upon such insertion, a given second clip 600 may be slid along a portion of the second strap 500 to a given location thereon, such location may correspond to a position at which an apparatus is to be affixed to a tower 101, when the second strap 500 is fastened to the tower 101.

The second inner prong 608, second top connecting portion 604, the second bottom connecting portion 610, and the second outer prong 606 may form a channel for insertion of the second clip 600 onto the second strap 500.

Figure 7A:
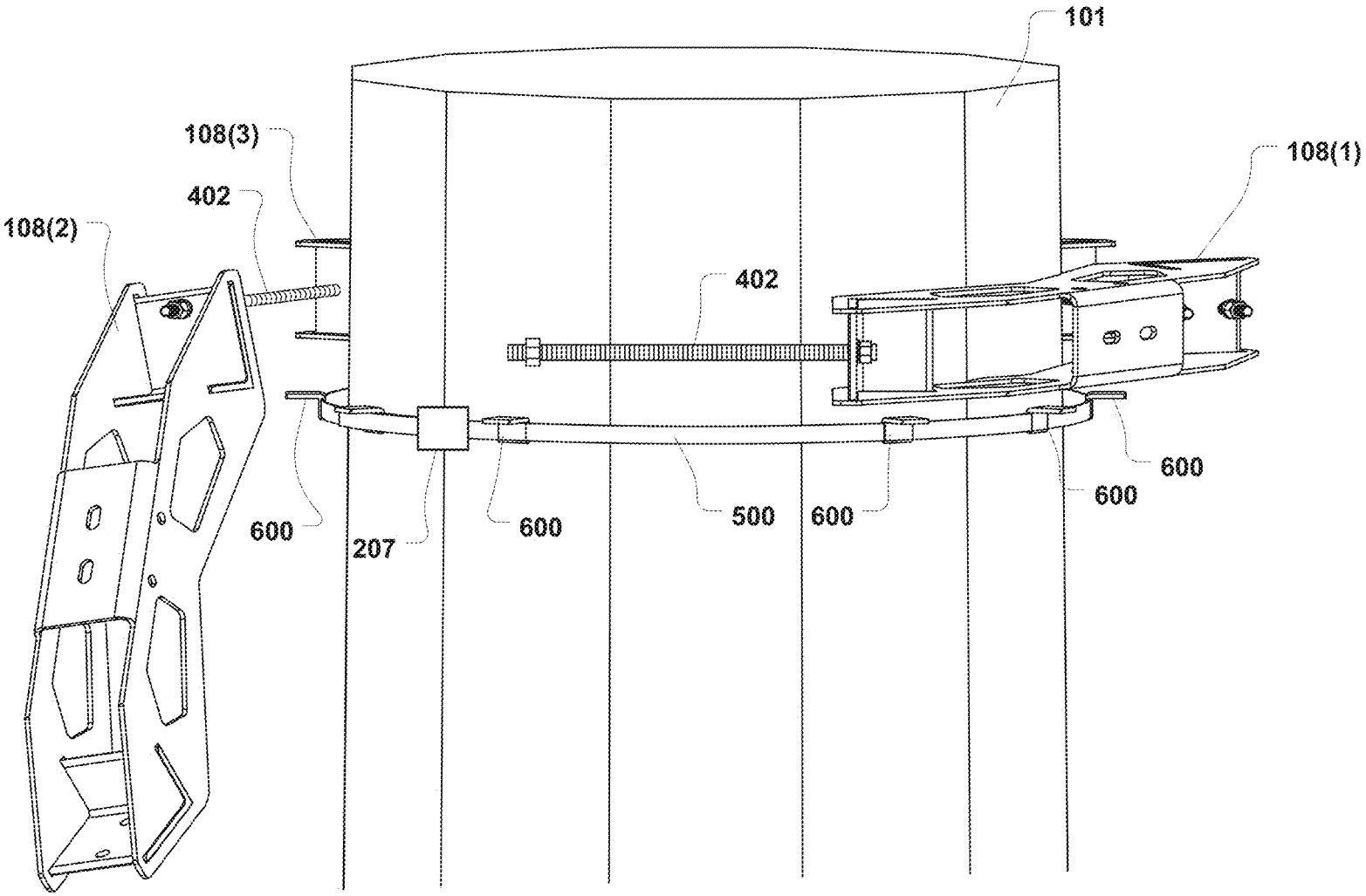
FIG. 7A is a partially assembled view of a second assembly of various apparatuses to a tower using the second adjustable collar strap of FIGS. 5A-5C and the second clip of FIGS. 6A-6D and in accordance with at least one first implementation of the present disclosure.
Figure 7C:
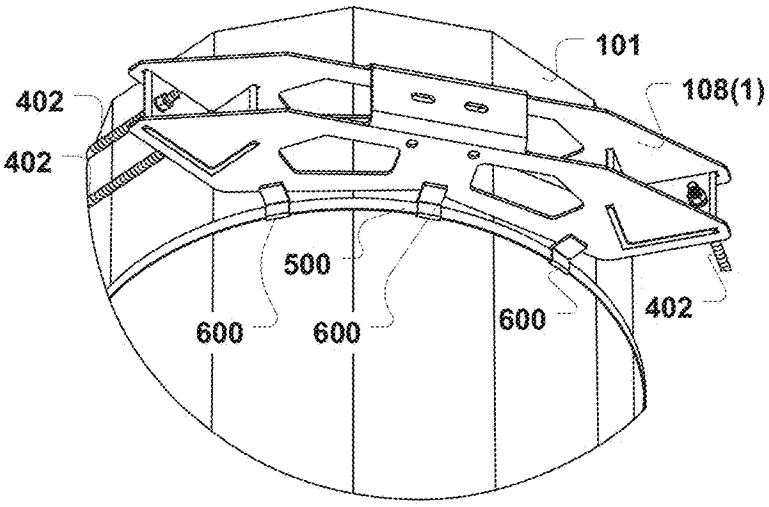
FIG. 7C is a bottom, enlarged side view of the second assembly of FIGS. 7A-7B.
Figure 7B:
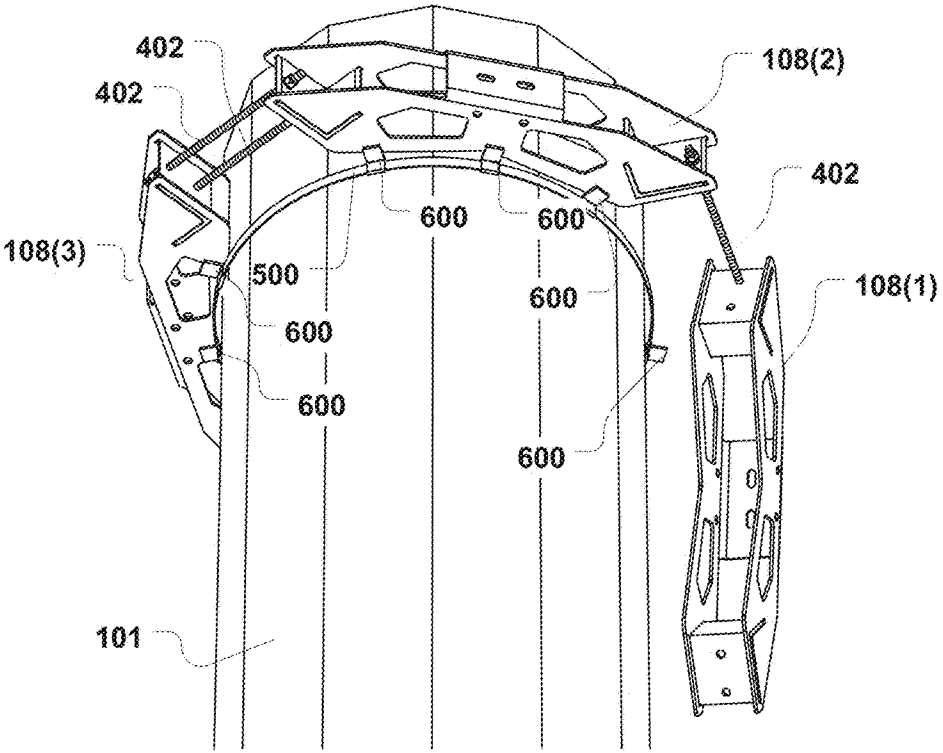
FIG. 7B is a bottom side view of the second assembly of FIG. 7A.

As shown in FIGS. 7A-7C, a second supporting assembly (which includes the second strap 500 and a plurality of second clips 600) may be attached to a tower 101 by the before-mentioned overlapping of the second strap first end 502 and the second strap second end 504 and securing the second strap 500 by use of the second clamp 507. It is to be appreciated that attachment of the second supporting assembly to a tower 101 may be performed using various tools or equipment and the second supporting assembly may be attached to be substantially parallel to a given ground or another horizontal plane. Further, one or more second clips 600 may be positioned on the second strap 500 and at one or more locations so as to facilitate the positioning, supporting and attachment of one or more brackets 108 about the tower 101. A given bracket 108 may be supported by any number of second clips 600. It is to be appreciated that the positioning of the one or more second clips 600 about the second strap 500 may coincide with a given location about a circumference of the tower 101.

For an implementation, one or more brackets 108 may be attached to a tower 101 using any known or later arising fasteners and/or fastening technologies. While being fastened to a tower 101, a bracket 108 may be supported by the second supporting assembly. As shown, for at least one implementation, a first bracket 108(1) may be attached to a second bracket 108(2), which in turn may be attached to a third bracket 108(3), and so forth by one or more tensioners 402, such as one or more machine bolts, or the like.

For an implementation, brackets 108 may be attached to the tower 101, while being supported by the second supporting assembly, using metal straps, welding, fasteners (such as bolts, screws, or the like), or any other known or later arising materials and techniques for fastening an apparatus to a tower 101. It is to be appreciated that upon completing a circle of brackets 108 coupled by tensioners 402, and the tightening of the tensioners 402, a plurality of brackets 108 may be attached and affixed (by surface tension) to a tower 101, on a substantially horizontal plane that is parallel to a given reference plane, such as a ground plane, and at a height set by an earlier attachment of the second supporting assembly to the tower 101. The brackets 108 may be used for attachment of one or more apparatus to the tower 101.

For an implementation, the brackets 108 may not be utilized and the one or more apparatus may be attached directly to a tower 101 using the second supporting assembly, as configured in accordance with an implementation of the present disclosure.

Figure 8:
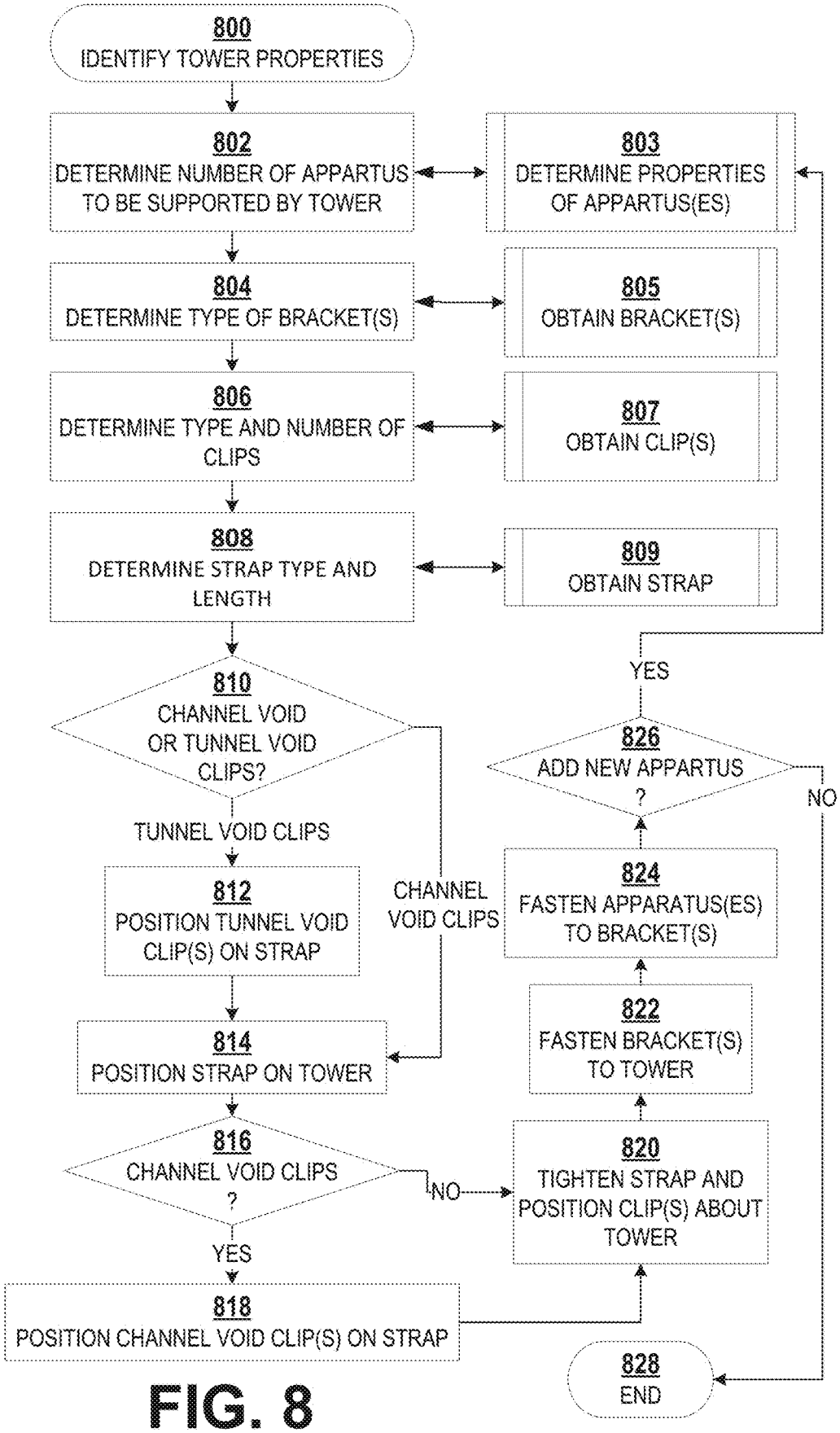
FIG. 8 is a flow chart illustrating a process for attaching an apparatus to a tower and in accordance with an implementation of the present disclosure.

In FIG. 8, a process for attaching an apparatus to a tower may is shown.

As per Operation 800, the process may include identifying properties for a given tower 101 upon which one or more apparatus are to be attached. The relevant dimensions may include, but are not limited to, the type of material used for the tower, diameter of the tower, acceptable means of attachment of apparatus to the tower 101, and other properties of the tower.

As per Operation 802, the process may include determining a number of apparatuses to be supported by the tower.

As per Operation 803, the process may include determining one or more properties of the one or more apparatus to be attached to the tower. Non-limiting examples of such properties include type of bracket 108, if any, used for attaching the apparatus to the tower 101, dimensions of the bracket 108 (when used), dimensions of the apparatus (when a bracket 108 is not used), dimensions and weight of the apparatus, and otherwise. The properties of a given first apparatus may vary from properties of another second apparatus. Different apparatus may be configured for use with different types and forms of brackets 108.

As per Operation 804, the process may include determining a type of bracket 108 to use for the one or more apparatus to be attached to the tower 101. It is to be appreciated that brackets may have varying sizes, weight tolerances, dimensions and otherwise. A first bracket 108(1) may be suited for use with a first number of clips (e.g., three), while a second bracket 108(2) may be suited for use with a second number of clips (e.g., one, two, four, or otherwise).

As per Operation 805, the process may include obtaining the bracket(s).

As per Operation 806, the process may include determining a number of and type of clips 300/600 for use with a given bracket 108 or apparatus (when a bracket is not used) to attach an apparatus to the tower. It is to be appreciated that a first clip 300 may be selected for use when a bracket or apparatus may be later added to a tower after one or more brackets and/or apparatus are already attached to the tower and a first supporting assembly is in use and the first supporting assembly is not to be removed from the tower. Likewise, it is to be appreciated that the second clip 600 may be selected for use when dislocation of a clip from a strap is to be avoided for one or more reasons, such as to prevent injury to items below from falling objects, or otherwise.

As per Operation 807, the process may include obtaining the clip(s).

As per Operation 808, the process may include selecting a strap. For at least one implementation, the strap type available for selection may include one of the first strap 200 and the second strap 500. For another implementation, the strap type available may include other forms of straps. For an implementation, selecting of a strap may include selecting a strap having one or more properties compatible for fastening of the strap to a given tower. For an implementation, selecting of a strap may include selecting a strap not having one or more properties, such as a strap that is or is not electrically conductive, is or is not corrosive, or otherwise.

As per Operation 810, the process may include determining whether the first clips 300, herein also referred to as a channel void clip, or the second clips 600, herein referred to as a tunnel void clip, were determined and obtained, as per Operations 806 and 807. For an implementation, one or more of both channel void clips and tunnel void clips may be determined and obtained. When at least one tunnel void clip is obtained, the process proceeds to Operation 812. When one or more channel void clips and no tunnel void clips are obtained, the process proceeds to Operation 814.

As per Operation 812, the process may include positioning the one or more tunnel void clips, as obtained per Operation 807, on the strap, as obtained per Operation 809. It is to be appreciated that insertions of tunnel void clips after a strap has been fastened to a tower may involve removal of the strap from the tower. Accordingly, for at least one implementation tunnel void clips are positioned on a strap prior to fastening of the strap to a given tower.

As per Operation 814, the process may include positioning the strap on the tower. When tunnel void clips are being used, Operation 814 may include fully tightening the strap to the tower such that it is secured to the tower and motion (upward/downward, rotational, or otherwise) of the strap relative to a given position and orientation (e.g., a ground plane parallel or horizontal orientation) of the strap on the tower is inhibited. When channel void clips are being used, Operation 814 may include partially tightening the strap to restrain movement of the strap relative to the tower while permitting attachment of channel void clips to the strap. For an implementation, channel void clips may be attached to a strap per Operation 812 and the combined and resulting supporting assembly may be positioned and secured to the tower per Operation 814.

As per Operation 816, a determination is made as to whether one or more channel void clips are to be used. It is to be appreciated that for an implementation, channel void clips may be used with the first strap 200. For another implementation, a channel void clip may be used with the second strap 500. When used with the second strap 500, a given channel void clip may be configured to not include a pin 310, as the second strap 500 does not contain an eyelet for engagement with the pin 310. If one or more channel void clips are to be used, the process may proceed to Operation 818 and otherwise may proceed to Operation 820.

As per Operation 818, the process may include positioning the one or more channel void clips on the strap. When the strap is a first strap 200 and includes one or more eyelets 206, a pin 310 for a given channel void clip may be aligned on the first strap with an eyelet 206.

As per Operation 820, the process may include tightening the strap to securely fasten the strap to the tower. The process may further include rotating the strap about the tower 101 until the supporting assembly provides at least one clip at a location and elevation which corresponds to a location for a bracket 108 to be attached to the tower 101.

As per Operation 822, the process may include fastening the one or more brackets obtained per Operation 805 to the tower. While fastening the bracket(s) to the tower, the bracket may rest on a top portion, such as a first top portion or a second top portion, of one or more clips positioned on the strap that has been secured to the tower per Operation 820. The fastening of the bracket(s) to the tower may use any known or later developed materials, processes, or otherwise. For an implementation, a plurality of brackets may be fastened to a tower using tensioners 402.

As per Operation 824, the process may include fastening one or more apparatus(es) to the one or more brackets fastened to the tower. The fastening of the apparatus(s) to the bracket(s) may use any known or later developed materials, processes, or otherwise. For an implementation, an apparatus may be fastened to a tower by use of one or more brackets that have been fastened to the tower while being supported by a supporting assembly configured in accordance with an implementation of the present disclosure.

As per Operation 826, the process may include determining whether a new apparatus is to be added to the tower. If so, the process may resume at any of the above described Operations including, but not limited to, resuming at the as shown Operation 803. When no additional apparatuses are to be added to the tower using a supporting assembly configured per an implementation of the present disclosure, the process may end, as per Operation 828.

It is to be appreciated that a supporting assembly may be used for at least one implementation to facilitate removal of apparatus and/or brackets from a tower by providing support to one or more brackets during an apparatus and/or bracket removal process. Such support may be used, for example, when a bracket that is secured to a tower by use of tensioners or otherwise connected to other brackets, may involve loosening of such tensioner and thereby results in other brackets and/or apparatus not being fastened to the tower.

Further, the operations described above and depicted in FIG. 8 are illustrative and are not intended herein to occur, for all implementations of the present disclosure, in the order shown, in sequence, or otherwise. One or more operations may be performed in parallel, and operations may not be performed, as provided for any given use of an implementation of the present disclosure.

Although various implementations have been described above with a certain degree of particularity, or with reference to one or more individual elements, operations, systems, devices and/or combinations thereof, those skilled in the art could make numerous alterations to the disclosed implementations. The use of the terms "approximately" or "substantially" means that a value of an element has a parameter that is expected to be close to a stated value or position. As is well known in the art, there may be minor variations that prevent the values from being as stated. Accordingly, anticipated variances, such as 10% differences, are reasonable variances that a person having ordinary skill in the art would expect and know are acceptable relative to a stated or ideal goal for one or more embodiments of the present disclosure. It is also to be appreciated that the terms "top" and "bottom", "left" and "right", "up" or "down", "first", "second", "next", "last", "before", "after", and other similar terms are used for description and ease of reference purposes and are not intended to be limiting to any orientation or configuration of any elements or sequences of operations for the various embodiments of the present disclosure. Further, the terms "coupled", "connected" or otherwise are not intended to limit such interactions and communication of signals between two or more devices, systems, components or otherwise to direct interactions; indirect couplings and connections may also occur. Further, the terms "and" and "or" are not intended to be used in a limiting or expansive nature and cover any possible range of combinations of elements and operations of an implementation of the present disclosure. The term "or" may be interpreted to mean "and/or" and not as an "exclusive or." Unless otherwise noted in the claims, stated values may be interpreted as illustrative and not be taken to be limiting.

Other implementations are contemplated. It is intended that all matter contained in the above description and shown in the accompanying drawings may be interpreted as illustrative of implementations and are not limiting. Changes in detail or structure may be made.

Based on design considerations, the components described above may be of approximately different shape than depicted in the Figures, while still operating in the same or an equivalent manner. For example, an implementation of a lock adapter may be taller, shorter, wider, thinner, or of different cross-sectional shape than depicted herein. A number of variations are possible on the examples and implementations described above.

Connection references, e.g., attached, coupled, connected, and joined are to be construed broadly and may include intermediate members between a collection of elements and relative movement between elements unless otherwise indicated. As such, connection references do not imply that two elements are directly connected and in fixed relation.

What is claimed is:

1. An assembly, for attaching an apparatus to a structure, comprising:

a bracket;

wherein the bracket is configured for mating with and attaching an apparatus to a structure;

a strap; and a channel void clip comprising:

a top portion;

an outer prong;

an inner prong; and a top connecting portion coupling the top portion to the outer prong, and further coupling a top of the inner prong to a top of the outer prong;

wherein the top connecting portion separates the inner prong from the outer prong to form a channel void therebetween;

wherein the channel void has dimensions which accept placement of the channel void clip onto the strap by the inner prong and the outer prong overlapping some of a middle portion of the strap; and wherein upon fastening of the strap onto the structure, the channel void clip and the strap provide a supporting assembly for the bracket during attachment of the bracket onto the structure;

whereupon the bracket being attached to the structure, the strap and the tunnel void clip are configured to facilitate removal of both the tunnel void clip and the strap from the structure without disturbing attachment of the bracket to the structure.

2. The assembly of claim 1, wherein the channel void clip has length of approximately forty-eight millimeters (48 mm);

wherein the channel void clip has a width of approximately thirty-eight millimeters (38 mm); and wherein the channel void clip has a height of approximately thirty-three millimeters (33 mm).

3. The assembly of claim 1, wherein the channel void has a length of approximately three millimeters.

4. The assembly of claim 1, wherein the top portion has a top length of forty millimeters; and wherein the top connecting portion has connecting length of eight millimeters.

5. The assembly of claim 1, wherein the inner prong is parallel to the outer prong.

6. The assembly of claim 1, wherein the inner prong has a first prong height;

wherein the outer prong has a second prong height; and wherein the inner prong height differs from the outer prong height.

7. The assembly of claim 1, further comprising:

a pin;

wherein the strap further comprises an eyelet; and wherein the pin is insertable into the eyelet during the fastening of the strap on the structure.

8. The assembly of claim 1, wherein the strap further comprises an eyelet; and wherein the channel void clip further comprises:

an opening in at least one of the inner prong and the outer prong; and a pin opposing the opening on another of the inner prong and the outer prong;

wherein the pin, upon insertion into the eyelet and the opening, secures the channel void clip at a middle position along the strap.

9. The assembly of claim 1, wherein the structure is a radio communications tower; and wherein the bracket facilitates mounting of an apparatus to the radio communications tower.

10. The assembly of claim 1, wherein the channel void clip is formed from aluminum.

11. An assembly, for securing an apparatus to a structure, comprising:

a bracket;

wherein the bracket is configured for mating with and securing an apparatus to a structure;

wherein the structure extends vertically, in a first direction, and substantially perpendicularly from a base; and wherein a second direction is substantially perpendicular to the first direction;

a strap; and a tunnel void clip comprising:

a top portion;

an outer prong having a substantially flat second surface extending in the first direction;

an inner prong having a substantially flat third surface extending in the first direction;

a top connecting portion coupling the top portion to the outer prong and further coupling the inner prong to the outer prong;

wherein the top portion extends from and is parallel with the top connecting portion;

wherein the top connecting portion and the top portion form a substantially flat first surface, extending in the second direction; and a bottom connecting portion coupling a bottom of the inner prong to a bottom of the outer prong;

wherein the top connecting portion and bottom connecting portion separate the inner prong from the outer prong to form a tunnel void therebetween;

wherein the tunnel void has dimensions which accept slidable insertion of one of a first end and a second end of the strap into and through the tunnel void;

wherein upon fastening of the strap onto the structure, the tunnel void clip and the strap provide a supporting assembly for the bracket during fastening of the bracket onto the structure;

wherein, the tunnel void clip is configured such that while fastened, by the strap, onto the structure, the tunnel void clip has an orientation where:

the top portion extends in the second direction away from the structure; and both the outer prong and the inner prong extend in the first direction and towards the base; and whereupon the bracket being secured to the structure, the strap and the tunnel void clip are configured to facilitate removal of both the tunnel void clip and the strap from the structure without disturbing securement of the bracket to the structure.

12. The assembly of claim 11, wherein the tunnel void clip has length of approximately forty-eight millimeters (48 mm);

wherein the tunnel void clip has a width of approximately thirty-eight millimeters (38 mm); and wherein the tunnel void clip has a height of approximately thirty-eight millimeters (38 mm).

13. The assembly of claim 11, wherein the top portion has a top length of forty millimeters; and wherein the top connecting portion has connecting length of eight millimeters.

14. The assembly of claim 11, wherein the tunnel void has a length of approximately three millimeters.

15. The assembly of claim 11, wherein the inner prong is parallel to the outer prong.

16. The assembly tunnel of claim 11, wherein the tunnel void clip is formed from aluminum.

17. The tunnel of claim 11, wherein the tower is a radio communications tower; and wherein the bracket facilitates mounting of an apparatus to the radio communications tower.

* * * * *